United States Patent [19]

Thorburn

[11] 4,229,956

[45] Oct. 28, 1980

[54] LOCKING MECHANISM

[76] Inventor: Maxwell Thorburn, P. O. Box 707, Clearlake Oaks, Calif. 95423

[21] Appl. No.: 973,038

[22] Filed: Dec. 26, 1978

[51] Int. Cl.[3] ..... E05B 63/14; E05C 1/02; E05C 5/02; E05C 13/02

[52] U.S. Cl. ..... 70/129; 292/57; 292/137; 292/148; 292/150; 70/134; 70/DIG. 63

[58] Field of Search ..... 70/118, 92, DIG. 63, 70/128–130, 120, 134; 292/57, 59, 60, 62, 148, 138, 137

[56] References Cited

U.S. PATENT DOCUMENTS

| | | | |
|---|---|---|---|
| 124,442 | 3/1872 | Kinkade | 292/57 |
| 365,152 | 6/1887 | Simson | 70/134 X |
| 777,135 | 12/1904 | Parsons | 292/57 |
| 1,143,398 | 6/1915 | Hoschek | 70/92 X |
| 1,661,584 | 3/1928 | Tozer | 70/118 |
| 1,806,031 | 5/1931 | Vignos | 70/DIG. 63 X |
| 3,027,744 | 4/1962 | Moore | 70/134 |
| 3,590,610 | 7/1971 | Hayakawa | 292/137 X |
| 3,731,505 | 5/1973 | Rosenberg et al. | 70/DIG. 63 X |
| 3,889,497 | 6/1975 | Tuttle | 70/DIG. 63 X |
| 4,066,284 | 1/1978 | Ikemura | 292/62 |

FOREIGN PATENT DOCUMENTS

| | | | |
|---|---|---|---|
| 91625 | 3/1923 | Austria | 70/134 |
| 418955 | 7/1910 | France | 70/134 |
| 1306055 | 9/1962 | France | 292/57 |
| 54620 | 12/1910 | Switzerland | 70/134 |

*Primary Examiner*—Roy D. Frazier
*Assistant Examiner*—Carl F. Pietruszka
*Attorney, Agent, or Firm*—Flehr, Hohbach, Test, Albritton & Herbert

[57] ABSTRACT

A locking mechanism is provided having a frame for mounting on a door or other closure. A movable bolt is supported on the frame for movements between extended and withdrawn positions. An additional member is mounted on the frame for slidable movements generally parallel to the bolt. At least two locking means are incorporated into the locking mechanism, the first of which releasably connects the bolt to the member, and the second of which releasably positions the member with respect to the frame. With the first locking means engaged, the bolt is movable together with the member. With both the first and second locking means engaged, the bolt is locked in the extended position. A securing means engagable with the first locking means prevents release of the first locking means. The locking mechanism is particularly adapted for use on storage compartments wherein a renter of the compartment will gain access by way of the first locking means and the owner will gain access by way of the second locking means. The securing means will enable the owner to disable the first locking means to prevent free access by the renter.

11 Claims, 7 Drawing Figures

LOCKING MECHANISM

The invention relates generally to locking mechanisms and more particularly to locking mechanisms of a type suitable for securing storage compartments or the like.

Locking devices operable independently by two or more separate locks have many applications. One application of such devices is on rented or assigned private storage compartments in which both a patron having assigned storage space and a supervisor or owner desire access to the compartment. For example, a patron renting a locked compartment or space in a storage facility would wish to have private access to his compartment, using his own key. The owner of the facility and possibly guards or others, might also wish to have access to the assigned compartments for the purpose of inspection or the like. It is particularly desirable in storage compartment locks of this type to allow the patron to install his own padlock to secure his compartment. Use of a padlock relieves the compartment owner of having to change or replace the lock each time a new patron is assigned to the space. An example of a prior art locking mechanism for storage compartments in which a private padlock is used for patron access and which has a second built-in lock for supervisory access is found in U.S. Pat. No. 1,806,031.

One difficulty with prior art locking devices which permit use of private padlocks, when such devices are used on rental storage compartments, is that the renter of the compartment will be the only person having the key or combination to the padlock. Unless the padlock is broken and replaced or an additional lock is installed, the renter cannot be prohibited access to the compartment. In the event of a failure to pay the rent on the part of the renter, the owner is forced to remove the renter's stored goods or to deny access by breaking the renter's private padlock, both of which entail expense to the owner.

It is a general object of the present invention to provide an improved locking mechanism for rental-type storage compartments.

It is another object of the present invention to provide a locking mechanism suitable for use on storage compartments which permits access by at least two separate locks, one of which is a padlock.

It is another object of the present invention to provide a locking mechanism which accommodates a padlock and in which the function of the padlock can be overriden to both permit unlocking of the mechanism with the padlock in place and prevent unlocking of the mechanism by removal of the padlock.

Accordingly, a locking mechanism is provided comprising a frame, a bolt supported on the frame for slidable movements between extended and withdrawn positions, and a member mounted on the frame for slidable movements generally parallel to the bolt. First locking means releasably connect the bolt to the member, and the bolt is movable together with the member when the first locking means is engaged. Second locking means releasably position the member with respect to the frame so as to restrict slidable movements thereof. The first and second locking means also cooperate with securing means engagable with the first locking means, and in which engagement of the securing means prevents release of the first locking means.

A preferred embodiment of the invention is described in detail below, with reference being made to the accompanying drawings, in which.

Figure 1:
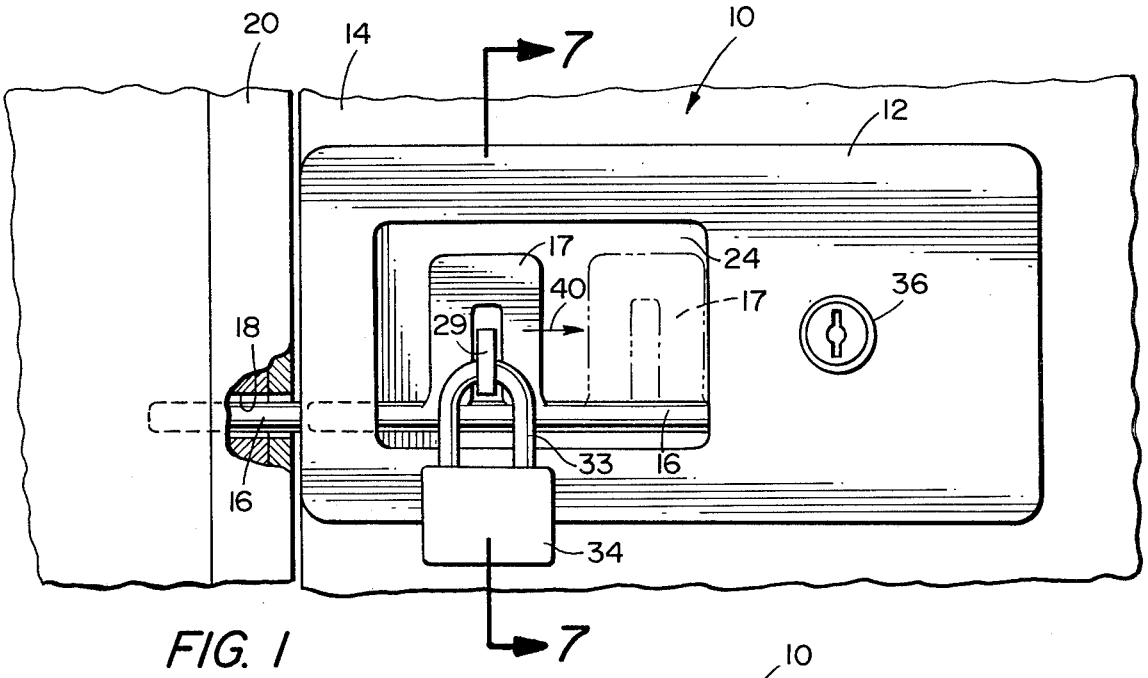
FIG. 1 is a front plan view of a locking mechanism according to the present invention with a padlock installed (solid lines) and the second locking means engaged.

Referring to FIG. 1, the illustrated locking mechanism 10 includes a frame 12 which is mounted on a door 14 or other closure which is to be secured by the locking mechanism. A bolt 16 is supported on frame 12 or slidable movements between extended and withdrawn positions. The bolt includes a perpendicular slotted tab 17 which can be grasped to rotate and move the bolt. In the extended position, shown with solid lines in FIG. 1, bolt 16 extends into a receiving opening 18 in jamb 20. The withdrawn position of bolt 16 is shown in phantom in FIG. 1.

Figure 2:
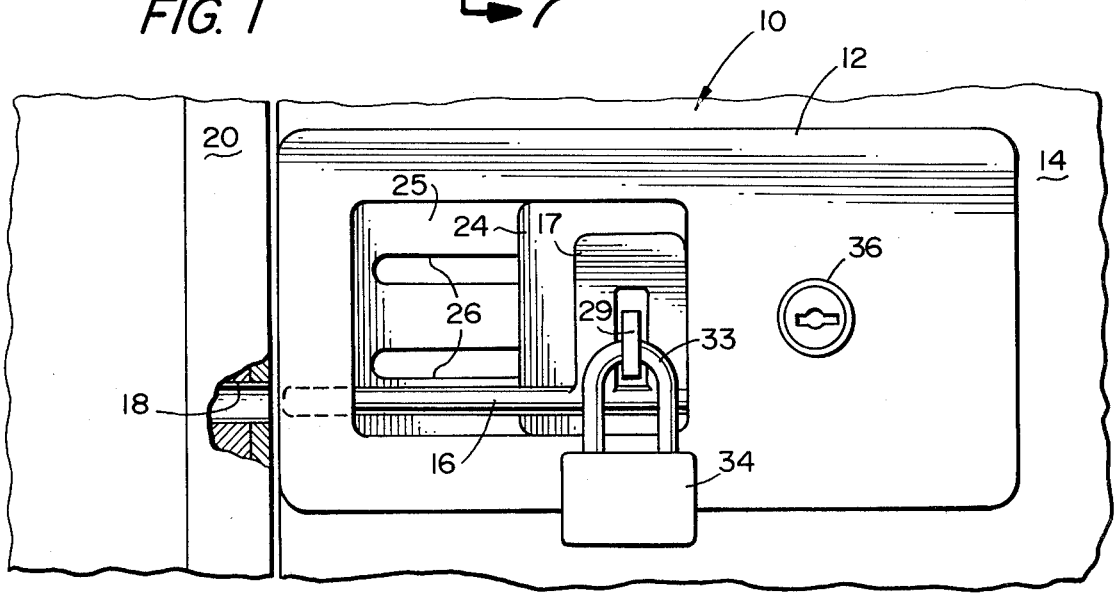
FIG. 2 is a plan view as in FIG. 1 in which the second locking means is released and the bolt is withdrawn with the padlock in place.
Figure 6:
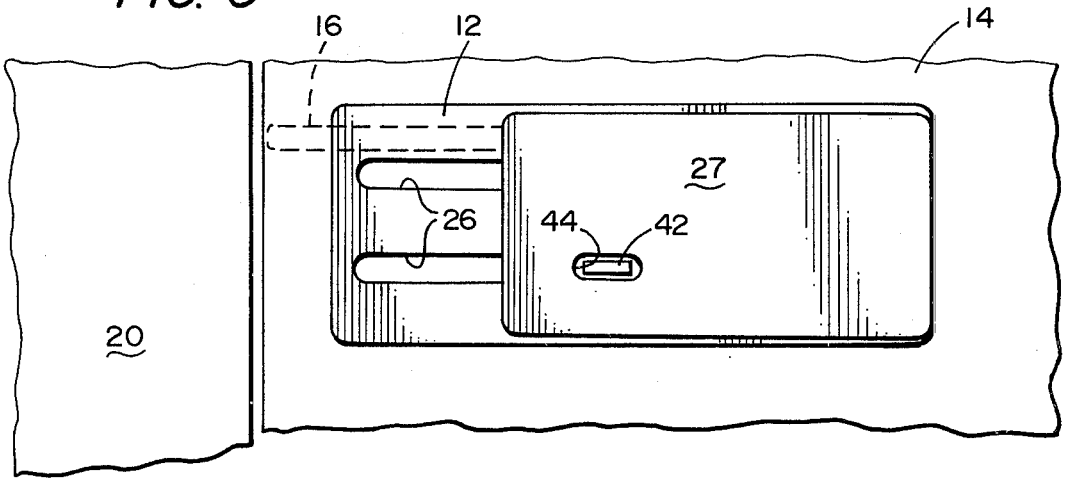
FIG. 6 is an inverted rear plan view of the locking mechanism as shown in FIG. 2.
Figure 7:
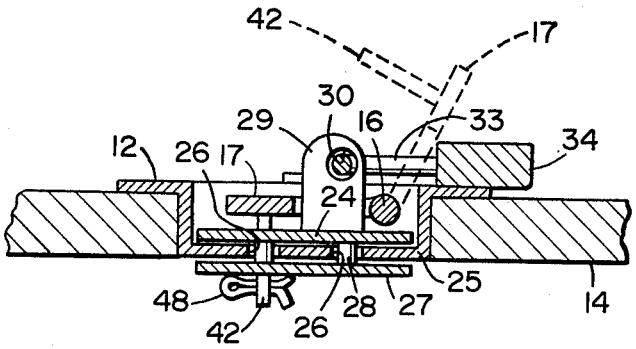
FIG. 7 is a rotated cross-sectional view taken on the line 7—7 of FIG. 1 showing (with solid lines) the locking mechanism as shown in FIG. 1 and showing the securing means engaged by the insertion of a pin therein.

A member 24 is also mounted on frame 12 for slidable movements generally parallel to bolt 16. In the preferred embodiment member 24 is in the form of a movable plate. Member 24 is supported on the rear wall 25 of frame 12, within horizontal slots 26 (see FIGS. 2 and 6). A rear plate 27 is connected to member 24 by studs 28 extending through slots 26 (see FIG. 7). A projecting tongue 29 is mounted on the front of member 24 to serve as a padlock clip. Tongue 28 includes an opening 30 for receiving a padlock shackle, as shown in FIG. 7. A slot 32 in tab 17 of bolt 16 can be positioned over tongue 29 by rotating and moving the bolt into the solid-line position shown in FIGS. 1 and 7. The shackle 33 of padlock 34 can then be installed in opening 30 to lock the bolt with respect to plate 24. The hasp-type padlock clip consisting of tongue 29 and slotted tab 17 serves as a first locking means for releasably connecting bolt 16 to member 24. When the first locking means is engaged and a padlock is installed, as shown in FIG. 1, bolt 16 is movable together with member 24 between the positions shown in FIGS. 1 and 2.

Figure 3:
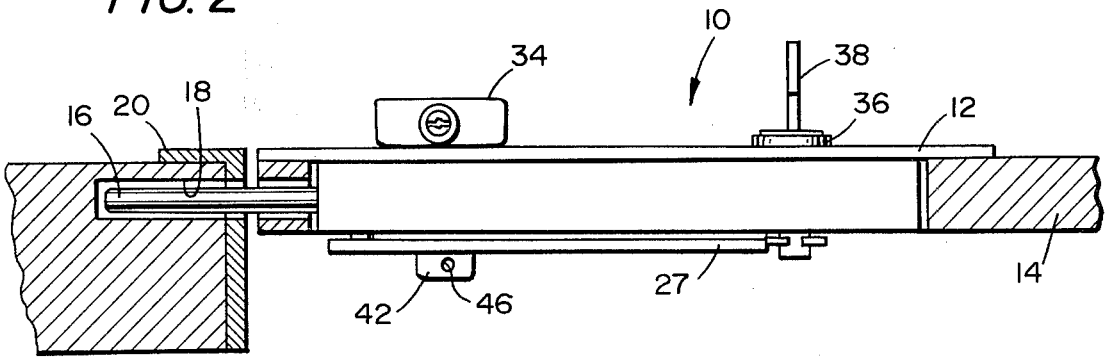
FIG. 3 is a bottom view of the locking mechanism as shown with solid lines in FIG. 1.
Figure 4:
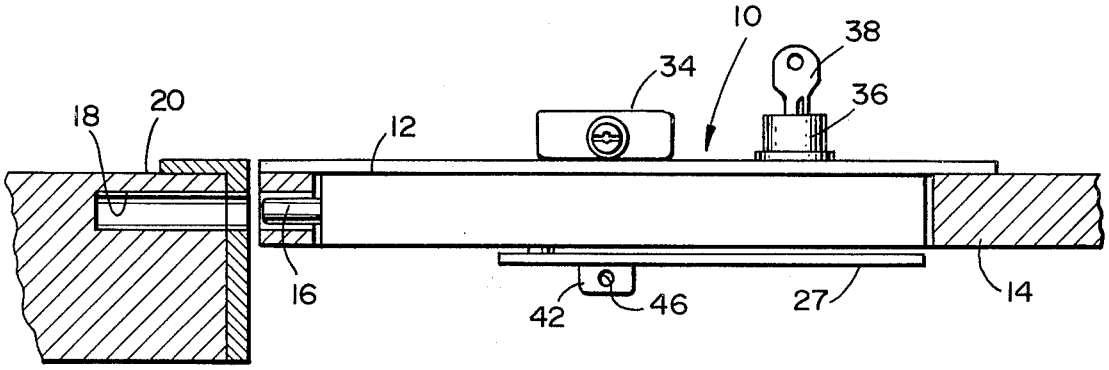
FIG. 4 is a bottom view of the locking mechanism as shown in FIG. 2.
Figure 5:
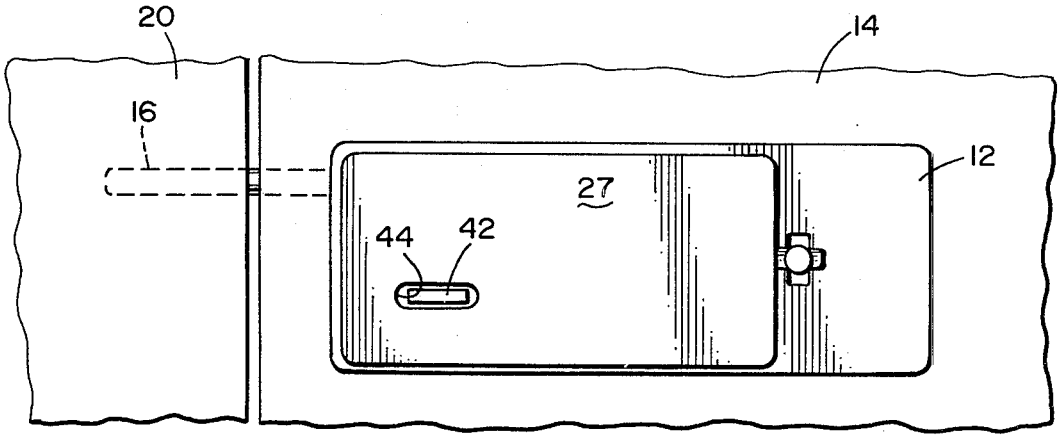
FIG. 5 is an inverted rear plan view of the locking mechanism as shown in FIG. 1.

A second locking means is incorporated into the locking mechanism to releasably position member 24 with respect to frame 12 and thereby restrict the slidable movements of member 24. In the preferred embodiment, the second locking means includes a built-in cylinder lock 36 which is operated by means of a key 38 (see FIGS. 3 and 4). Cylinder lock 36 can be engaged to lock member 24 in the position shown in FIGS. 1, 3 and 5. When the cylinder lock is released, member 24 is freely movable between the positions shown in FIGS. 1 and 2. If bolt 16 is tied to member 24 by the above-described padlock clip, the bolt will move with member 24.

Bolt 16 is locked in the extended position shown in FIG. 1 (solid lines) when the hasp-type padlock clip is engaged, with tongue 29 extending through slot 32 in tab 17, and when cylinder lock 36 is locked. The bolt can be withdrawn in one of two ways. the padlock 34 can be removed and the bolt rotated and pulled in the direction of arrow 40 to free tab 22 from tongue 28. An alternative method is to release cylinder lock 36 and slide both member 24 and the bolt and accompanying padlock clip in the direction of arrow 40 to the position shown in FIG. 2. The latter method of releasing the bolt effectively overrides the function of the padlock clip.

The locking mechanism further includes a securing means which cooperates with the above-described locking features. The securing means is engagable with tab 17 of bolt 16 to prevent release of the padlock clip. A rearwardly-extending projection 42 is provided on tab 17 (visible in FIGS. 3–7) to prevent rotation of the tab and bolt 16. The projection 42 is aligned with one of the slots 26 in frame 12. When tab 17 is in the position shown with solid lines in FIG. 7, projection 42 extends through an opening 44 in the rear plate 27 and a similar opening (hidden from view) in member 24. As tab 17 is rotated from the position shown in phantom in FIG. 7 to the solid line position, projection 42 passes through slot 26 and the other openings and extends out the back side of the locking mechanism. To operate as a securing means, the projection is provided with an opening 46 for receiving a removable pin, such as the cotter pin 48 illustrated in FIG. 7. With a pin such as pin 48 inserted in opening 46, the securing means becomes engaged and prevents rotation of tab 17 and bolt 16 and thereby prevents disengagement of the tab from tongue 29. As such, the securing means operates as a third locking means which overrides the function of the padlock clip to prevent withdrawal of the bolt even when the padlock is removed. With a pin in opening 46, the only way to withdraw bolt 16 is to release cylinder lock 36 and move plate 24 and the bolt together.

As is evident from the figures, access to the padlock clip and cylinder lock 36 is from the front of the locking mechanism. The above-described securing means formed by projection 42 is accessible only from the back of the locking mechanism. Thus, when the mechanism is installed on a door or the like and is used to secure an enclosure, the padlock clip and cylinder lock will be accessible from outside the enclosure and the securing means will be accessible only from within the enclosure.

Operation of the locking mechanism of the present invention is best described in connection with its use on a door to a rental storage area or compartment. Frame 12 is preferably mounted within an opening in a door or adjacent door jamb. The front side of the mechanism, shown in FIGS. 1–2, will be on the outside of the storage area to be secured. During normal use, no pin will be used in opening 46 of projection 42, and the mechanism will be operated either by using the padlock clip or the cylinder lock, The owner of the storage facility will keep the key to cylinder lock 36 and the renter of the storage space will supply his own padlock 34. The renter can gain access to the storage compartment by removing the padlock from the padlock clip, rotating tab 17 and bolt 16 to disengage slot 32 from tongue 29, and withdrawing the bolt. The storage area is resecured by reversing the process and reinstalling the padlock. If the owner of the storage facility desires access to the renter's compartment, he will unlock cylinder lock 36 and slide member 24, along with bolt 16 and the padlock clip and padlock, in the direction of arrow 40 (FIG. 1) to withdraw the bolt. Either party thus has access to the storage compartment by way of entirely separate locks.

The securing means on tab 17 can be used by the owner of the storage facility to prevent access to the compartment by the renter. The owner will first gain access to the compartment by using cylinder lock 36, and will then insert a pin in opening 46 of projection 42. The pin prevents rotation of bolt 16 and tab 17 even when the padlock is removed. Thus, the renter cannot withdraw the bolt and has no access to the compartment, nor can he remove the pin. The bolt can only be withdrawn by unlocking cylinder lock 36. Use of the securing means is particularly desirable where a renter has failed to pay the rent or is otherwise violating the rental agreement.

The locking mechanism of the present invention offers a highly convenient means for securing rental storage units. The mechanism allows for the use of a renter's own padlock to lock his compartment, thereby eliminating the expense of changing locks and keys whenever a new renter acquires the space. Convenient separate access is offered to both the renter and owner of the storage space. And the owner is offered an extremely convenient means for denying access to a renter who fails to observe his contract. The insertion of a pin in the securing means to prevent access by the renter involves virtually no expense. By contrast, other remedies available to the owner of a storage facility, such as eviction of the renter's goods, breaking or changing the renter's lock, or adding a new lock to the storage space, all involve considerable expense.

Alternative forms of locking mechanism are possible within the scope of the present invention. The types of locks employed on the front side of the mechanism are suggestive only, and other types of locks could be used. Combination-type locks could be used, for example. Both of the locks on the front side of the mechanism could be padlocks. Alternative types of securing means would be possible, to prevent the release of the first locking means. Although the preferred embodiment shows a dead-bolt type lock, other types of locks could be employed with the present invention.

The invention provides an improved locking mechanism for rental-type storage compartments. The invention provides a locking mechanism, suitable for use on storage compartments, which permits access by at least two separate locks, one of which is a padlock. The invention further provides a locking mechanism which accommodates a padlock and in which the function of the padlock can be overridden to both permit unlocking of the mechanism with the padlock in place and prevent unlocking of the mechanism by removal of the padlock.

What is claimed is:

1. A locking mechanism comprising: a frame, a bolt supported on said frame for slidable movements between extended and withdrawn positions, a member mounted on said frame for slidable movements generally parallel to said bolt, first locking means for releasably connecting said bolt to said member, said bolt being movable together with said member when said first locking means is engaged, second locking means for releasably positioning said member with respect to said frame so as to restrict slidable movements thereof, said first and second locking means cooperating with securing means engagable with said first locking means, and in which engagement of said securing means prevents release of said first locking means.

2. A locking mechanism as in claim 1 in which said first locking means includes means for receiving a padlock.

3. A locking mechanism as in claim 1 in which said first and second locking means are accessible from a front side of said mechanism, and said securing means is accessible only from the back of said mechanism, whereby when said mechanism is used to secure an enclosure said first and second locking means will be accessible from outside said enclosure and said securing means will be accessible only from within said enclosure.

4. A locking mechanism as in claim 3 in which said securing means includes a third locking means accessible only from the back of said mechanism.

5. A locking mechanism as in claim 1 in which said securing means includes means for receiving a removable pin, said securing means being engaged by insertion of a pin therein.

6. A locking mechanism as in claim 1 in which said second locking means includes a cylinder lock mounted on said frame.

7. A locking mechanism as in claim 1 in which said member includes a movable plate mounted for slidable movements on said frame and a projecting tongue having an opening for receiving a padlock shackle, said bolt including a slotted portion for engaging said tongue to permit a padlock installed in said opening to secure said first locking means.

8. A locking mechanism as in claim 7 in which said slotted portion of said bolt includes a tab on said bolt with a slot therein, said bolt being rotatable to permit said tab to be raised and moved into engagement with said tongue on said movable plate.

9. A locking mechanism as in claim 8 in which said securing means includes means for preventing rotation of said bolt to prevent disengagement of said tongue and said tab.

10. A locking mechanism as in claim 9 in which said means for preventing rotation includes means on said tab for receiving a removable pin.

11. A locking mechanism as in claim 10 in which said projecting tongue and opening for receiving a padlock shackle on said movable plate and said second locking means are both accessible from a front side of said mechanism, and said means on said tab for receiving a removable pin is accessible only from the back of said mechanism whereby when said mechanism is used to secure an enclosure said opening for receiving a padlock shackle and said second locking means will be accessible from outside the enclosure and said means for receiving a removable pin will be accessible only from within the enclosure.

* * * * *